United States Patent [19]

Kumagai et al.

[11] Patent Number: 4,950,574

[45] Date of Patent: Aug. 21, 1990

[54] TONER FOR DEVELOPING ELECTROSTATIC IMAGE COMPRISING VINYL POLYMER HAVING HYDROXYL NUMBER OF 50 TO 350

[75] Inventors: Yuugo Kumagai; Isamu Moribe; Ikutoshi Shibuya, all of Hitachi, Japan

[73] Assignee: Hitachi Chemical Company, Ltd., Tokyo, Japan

[21] Appl. No.: 697,755

[22] Filed: Feb. 4, 1985

[30] Foreign Application Priority Data

Feb. 6, 1984 [JP] Japan ..... 59-20604

[51] Int. Cl.[5] ..... G03G 9/08

[52] U.S. Cl. ..... 430/109; 430/106.6

[58] Field of Search ..... 430/109, 106.6

[56] References Cited

U.S. PATENT DOCUMENTS

| | | | |
|---|---|---|---|
| 3,595,794 | 7/1971 | Hagenbach et al. | 430/108 |
| 3,669,885 | 6/1972 | Wright et al. | 430/108 |
| 4,152,279 | 5/1979 | Mincer et al. | 430/110 X |

*Primary Examiner*—J. David Welsh

*Attorney, Agent, or Firm*—Antonelli, Terry, Stout & Kraus

[57] ABSTRACT

A toner comprising a vinyl polymer having a hydroxyl number of 50 to 350 and a glass transition point of 35° to 100° C., obtained from one or more monomers having a secondary hydroxyl group and, if necessary, one or more vinyl monomers copolymerizable with the vinyl monomer having a secondary hydroxyl group, is excellent in resistance to adhesion to non-rigid polyvinyl chloride and resistance to blocking under high humidity.

11 Claims, No Drawings

TONER FOR DEVELOPING ELECTROSTATIC IMAGE COMPRISING VINYL POLYMER HAVING HYDROXYL NUMBER OF 50 TO 350

BACKGROUND OF THE INVENTION

This invention relates to a toner for developing electrostatic images usable in the fields of electrophotography, electrostatic recording, and the like.

In the electrophotography and electrostatic recording, a printed image can be produced, for example, by steps of forming an electrostatic image on a photoconductive layer by a various kinds of means, developing the electrostatic image with toner particles, transferring the toner which formed the image to a transferring material such as paper, Mylar film, etc., and fixing with heated rolls, pressure rolls, heated pressure rolls, or flash light from a xenon lamp.

Copied products are sometimes stored in a file containing sheets of non-rigid polyvinyl chloride in order to prevent stain and damage and to use for a long period of time.

As toners for developing electrostatic images usable in the electrophotography and electrostatic recording, there have been known toners using vinyl resins such as a toner using a polystyrene resin (Japanese Patent Appln Kokoku (Post-Exam Publn) No. 16118/69), a toner using a styrene-butyl methacrylate copolymer resin (Japanese Patent Appln Kokoku (Post-Exam Publn) No. 1143/81), etc., a toner using a bisphenol type epoxy resin obtained by reacting a bisphenol with epichlorohydrin (Japanese Patent Appln Kokai (Laid-Open) No. 96354/82), a toner using a polyester resin obtained by reacting a glycol having a bisphenol skelton with a polybasic acid (U.S. Pat. No. 3,681,106) and the like. Since the vinyl resins can be controlled in wide range regarding physical properties such as molecular weight, glass transition point, molten viscosity, etc., and are very advantageous for designing toners, almost toners are obtained by using these vinyl resins. But the toners hereto known using vinyl resins have a fatal defect in that when copied products obtained by using such toners are stored in contact with sheets of non-rigid polyvinyl chloride, the printed letters and images are adhered to the sheets to produce defects of printed letters and images and to make it impossible to read the letters and images.

SUMMARY OF THE INVENTION

It is an object of this invention to provide a toner for developing electrostatic images overcoming the above-mentioned problem and suitable for dry development without adhering to non-rigid polyvinyl chloride and causing no blocking even under high humidity.

This invention provides a toner for developing electrostatic images comprising a vinyl polymer having at least one group selected from the group consisting of a group of the formula:

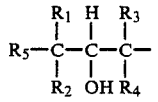

(I)

wherein $R_1$ through $R_5$ are independently hydrogen or a hydrocarbon group, in side chains of the polymer, and a group of the formula:

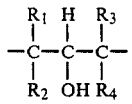

(II)

wherein $R_1$ through $R_4$ are as defined above, in the main chain of the polymer, said vinyl polymer having a hydroxyl number of 50 to 350 and a glass transition point of 35 to 100° C.

DESCRIPTION OF THE PREFERRED EMBODIMENTS

The vinyl polymer used in this invention has a hydroxyl number of 50 to 350 (KOH mg/g), preferably 80 to 250 (KOH mg/g). The group of the formula (I) and/or (II) should have 60% or more, preferably 80% or more, of the hydroxyl groups. When the hydroxyl group content in the formula (I) and/or is too small, resistance to blocking under high humidity is lowered.

Further, when the hydroxyl number of the vinyl polymer is less than 50, prevention of adhesion to non-rigid polyvinyl chloride cannot be attained, while when the hydroxyl number is more than 350, there take place various troubles in that moisture absorption amount under high humidity (under high humidity of 60% RH or more) increases, charging characteristics of the toner are lowered, and blocking easily takes place.

The vinyl polymer used in this invention should have a glass transition point of 35 to 100° C., preferably 40 to 80° C. When the glass transition point is less than 35° C., the toner is lessened in resistance to blocking, while when higher than 100° C, the fixing properties become poor. The glass transition point is measured by the thermo mechanical analysis method (penetration mode: load 70 gf/cm$^2$, temperature rise rate 10° C./min).

The vinyl polymer should have at least one group selected from a group of the formula:

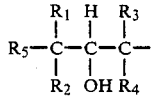

(I)

wherein $R_1$ through $R_5$ are independently hydrogen or a hydrocarbon group such as $C_{1-4}$ alkyl, phenyl, etc., in side chains of the polymer, and/or a group of the formula:

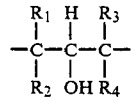

(II)

wherein $R_1$ through $R_4$ are as defined above, in the main chain of the polymer.

The vinyl polymer can be obtained by polymerization or copolymerization of vinyl monomers having a secondary hydroxyl group.

Examples of the vinyl monomers having a secondary hydroxyl group are 2-hydroxypropyl methacrylate, 2-hydroxybutyl methacrylate, 3-hydroxybutyl methacrylate, an adduct of glycidyl methacrylate and methacrylic acid or acrylic acid, an adduct of a bisphenol type epoxy resin and methacrylic acid or acrylic acid (epoxy ester), 2-hydroxypropyl acrylate, 2-hydroxybutyl acrylate, 3-hydroxybutyl acrylate, an adduct of glycidyl acrylate and methacrylic acid or acrylic acid, and the like.

These monomers can be used alone or as a mixture thereof. Considering properties of the resulting resins (resistance to adhesion to non-rigid polyvinyl chloride, and molten viscosity), the use of 2-hydroxypropyl methacrylate and 2-hydroxypropyl acrylate is preferable.

Among the vinyl monomers having a secondary hydroxyl group, there are known those having a chlorine atom in a substituent such as 3-chloro-2-hydroxypropyl methacrylate, etc. Such compounds have properties of being changed to glycidyl methacrylate by itself by dehydrochlorination with ease under basic conditions or forming a salt by a reaction with an amine compound. Such properties can also be applied to polymers or copolymers obtained polymerizing or copolymerizing such compounds. Thus, a toner containing such a polymer as a major constituent may be influenced by an additive for toner such as a colorant, a charge control agent, or the like having various chemical properties to cause dehydrochlorination, which results in losing hydroxyl groups in the polymer and easily lowering the resistance to adhesion to non-rigid polyvinyl chloride of the toner. Further, there arise problems of corrosion of toner producing machines and safety and health of workers caused by the elimination of hydrochloric acid. In addition, the formation of salt increases moisture absorbability, which results in easily causing lowering in charging characteristics and deterioration of blocking resistance. Therefore, the use of such compounds for producing polymers for major component of toner is not preferable considering practical use.

It is also possible to use vinyl monomers having a hydroxyl group other than the secondary hydroxyl group in addition to the vinyl monomers having a secondary hydroxyl group. Examples of such monomers are 2-hydroxyethyl methacrylate, 3-hydroxypropyl methacrylate, 2-hydroxyethyl acrylate, 3-hydroxypropyl acrylate, etc.

As vinyl monomers copolymerizable with the vinyl monomers having a hydroxyl group, there can be used styrene and derivatives thereof such as $\alpha$-methylstyrene, p-methylstyrene, p-tert-butylstyrene, p-chlorostyrene, divinylbenzene, etc.; methacrylic acid and esters thereof such as methyl methacrylate, ethyl methacrylate, propyl methacrylate, butyl methacrylate, pentyl mathacrylate, hexyl methacrylate, heptyl methacrylate, octyl methacrylate, nonyl methacrylate, decyl methacrylate, undecyl methacrylate, dodecyl methacrylate, glycidyl methacrylate, etc.; acrylic acid and esters thereof such as methyl acrylate, ethyl acrylate, propyl acrylate, butyl acrylate, pentyl acrylate, hexyl acrylate, heptyl acrylate, octyl acrylate, nonyl acrylate, decyl acrylate, undecyl acrylate, dodecyl acrylate, glycidyl acrylate, etc.; vinyl acetate, vinyl chloride, acrylonitrile, methacrylonitrile, butyl vinyl ether, etc. These monomers can be used alone or as a mixture thereof. Among these monomers, preferable ones are styrene, styrene derivatives, methacrylic acid esters, acrylic acid esters, and particularly preferable ones are mathacrylic acid esters and acrylic acid esters containing an alkyl group having 1 to 5 carbon atoms.

When the vinyl monomers have two or more polymerizable double bonds, it is preferable to use such monomers in an amount of 0 to 1% by weight based on the total weight of the vinyl monomers.

The above-mentioned vinyl monomers can be polymerized by any methods such as solution polymerization, bulk polymerization, emulsion polymerization, suspension polymerization, and the like.

As polymerization initiator for the polymerization of these vinyl monomers, there can be used acetyl peroxide, decanoyl peroxide, lauroyl peroxide, benzoyl peroxide, p-chlorobenzoyl peroxide, 2,4-dichlorobenzoyl peroxide, diisopropyl perdicarbonate, di-2-ethyl-hexyl perdicarbonate, acetyl cyclohexane sulfonyl peroxide, tert-butyl peracetate, tert-butyl perisobutyrate, azobisisobutyronitrile, tert-butyl per-2-ethylhexanoate, tert-butyl perbenzoate, etc. The polymerization initiator can preferably be used in an amount of 0.1 to 15% by weight based on the total weight of the vinyl monomer or monomers.

The vinyl polymer used in this invention may be a mixture of two or more polymers and/or copolymers obtained from the above-mentioned vinyl monomers so long as the mixture has the hydroxyl number and the glass transition point as defined above. Therefore, it is possible to use a mixture of one or more vinyl polymers having hydroxyl groups and one or more vinyl polymers having no hydroxyl groups.

The toner of this invention may contain one or more colorants and/or magnetic powders, and if necessary, one or more conventional additives such as charge control agents, offset prevention agents, and the like.

Examples of the colorant are carbon black, iron oxide pigments, phthalocyanine blue, phthalocyanine green, rhodamine 6G lake, Watching Red Barium, Watching Red Strontium, and the like conventional ones. These colorants can preferably be used in an amount of 1 to 60% by weight based on the weight of the toner.

Examples of the magnetic powder are fine powders of metals such as iron, manganese, nickel, cobalt, etc., ferrites of iron, manganese, nickel, cobalt, zinc, etc. It is preferable to use magnetic powders having an average particle size of preferably 10 $\mu$m or less, more preferably 1 $\mu$m or less. The magnetic powder is preferably used in an amount of 10 to 70% by weight based on the weight of the toner. When the magnetic powder is used together with the colorant, it is preferable to use the colorant in an amount of 10% by weight or less.

Examples of the charge control agent are nigrosine dye, fatty acid modified nigrosine dyes, metal-containing nigrosine dyes, metal-containing fatty acid modified nigrosine dyes, chromium complex of 3,5-di-tertbutyl salicylate, dibutyl tin oxide, etc. The charge control agent can preferably be used in an amount of 0 to 20 parts by weight based on the weight of the toner.

The offset prevention agent is used depending on necessity. The offset prevention agent can be present in the polymerization system in any form at the time of polymerization so as to be included in the final product of toner. Alternatively, the offset prevention agent can be added to the toner of this invention in a later stage. Examples of the offset prevention agent are various natural waxes such as carnauba wax, hardened castor oil, low molecular weight olefin polymer, and the like. The use of low molecular weight olefin polymer is preferable. As the low molecular weight olefin polymer, there can be used polymers of olefins, copolymers of an olefin and a monomer other than olefin, these polymers and copolymers having a low molecular weight. Examples of olefin are ethylene, propylene, butene-1, etc. Examples of the monomer other than olefin are acrylic esters, methacrylic esters, etc. The molecular weight of the low molecular weight olefin polymer is sufficient when included in a general concept of low molecular weight in the field of organic high polymers. Generally speaking, the molecular weight is 1,000 to 45,000, preferably 2,000 to 6,000 in terms of weight-average molecular weight. Further, it is preferable to use the low molecular weight olefin polymer having a softening point of 100 to 180° C., particularly preferably 130 to 160° C.

There is particularly no limit to the amount of the low molecular weight olefin polymer, but the amount of 0 to 30% by weight based on the weight of the toner is preferable.

The toner of this invention may further contain a fluidity improving agent, cleaning improving agent, etc. as other additives, if necessary. Such additives can be added to the polymerization reaction system so as to be included in the final product of toner, but are preferably added to the product of toner afterward. Such additives can be added in amounts of 0 to 3% by weight, respectively, based on the weight of the toner.

Examples of the fluidity improving agent are silanes, titanium, aluminum, calcium, magnesium and magnesium oxide, and a product obtained by subjecting magnesium oxide to a hydrophobic treatment with a titanium coupling agent or silane coupling agent.

Examples of the cleaning improving agent are metal salts of higher fatty acids such as zinc stearate, lithium stearate, magnesium laurate, etc., and aromatic acid esters such as pentaerythritol bonzoate, etc.

In this invention, the so-called charge amount and charge polarity of the toner product can be controlled freely by properly selecting the polymerizable monomer and the colorant. In order to adjust the charge amount and the charge polarity to more desirable values, a charge control agent can be added to the toner together with a colorant.

The above-mentioned raw materials for the toner can be mixed by the following mixing methods.

That is, weighed raw materials are premixed by using a W cone, a V blender, a Henschel mixer, or the like, and kneaded by using a pressure kneader, a Banbury mixer, a heated roll, an extruder, or the like at a temperature of melting the resin. After cooled, the resulting mixture is ground by using a feather mill, a pin-type mill, a pulverizer, a hammer mill, or the like, followed by pulverization by means of jet air. The resulting powder is sieved by using an Acucut classifier, ALPINE classifier, or the like to adjust the particle size preferably to to 30 μm.

The toner of this invention can be applied to various developing process such as the cascade developing method disclosed in U.S. Pat. No. 2,618,552, the magnetic brush method disclosed in U.S. Pat. No. 2,874,065, the powder cloud method disclosed in U.S. Pat. No. 2,221,776, the touchdown development method disclosed in U.S. Pat. No. 3,166,432, the so-called jumping method disclosed in Japanese Patent Appln Kokai (Laid-Open) No. 18656/80, the so-called microtoning method using a magnetic toner produced by a grinding method as a carrier, the so-called bipolar magnetic toner method wherein necessary toner charge is obtained by triboelectric charge of magnetic toners each other, and the like.

Various fixing methods such as a so-called oilless and oil coating heat roll method, a flash method, an oven method, a pressure fixing method, etc. can be applied to the toner of this invention.

This invention is illustrated by way of the following Examples.

Examples 1 to 12 and Comparative Examples 1 to 4

(1) Production of Copolymers

In a reactor, 2000 g of water and 3 g of a suspending agent (poly vinyl alcohol), Denka Poval W-24, a trade name manufactured by Denki Kagaku Kogyo Kabushiki Kaisha) were placed and made into a uniform solution. The temperature was raised to 90° C. Then, vinyl monomers and benzoyl peroxide as polymerization initiator as listed in Table 1 were added to the resulting solution dropwise in about 1 hour and maintained at 90° C. for 10 hours. Then, the reaction solution was cooled, filtered and dried sufficiently to give copolymers. The conversion was 99% or more in each case.

The hydroxyl numbers and the glass transition points of the copolymers were measured and listed in Table 1.

TABLE 1

| Copolymer No. | A-1 | A-2 | A-3 | A-4 | A-5 | A-6 | A-7 | A-8 | B-1 | B-2 | B-3 | B-4 |
|---|---|---|---|---|---|---|---|---|---|---|---|---|
| 2-Hydroxypropyl methacrylate (g) | 443 | 510 | 257 | — | 505 | 300 | 246 | 308 | — | 80 | 257 | — |
| 2-Hydroxypropyl acrylate (g) | — | — | — | 200 | 123 | — | — | — | — | — | — | — |
| Styrene (g) | 542 | 465 | 633 | 700 | 372 | 648 | 579 | 592 | 800 | 850 | 445 | 510 |
| n-Butyl acrylate (g) | 15 | 25 | 110 | 100 | — | 52 | 50 | 30 | 200 | 70 | 298 | 90 |
| 2-Hydroxyethyl methacrylate (g) | — | — | — | — | — | — | 125 | 70 | — | — | — | 400 |
| Benzoyl peroxide (g) | 70 | 60 | 20 | 10 | 35 | 30 | 30 | 30 | 30 | 60 | 70 | 70 |
| Hydroxyl Number (KOH mg/g) | 173 | 199 | 100 | 86 | 250 | 117 | 150 | 150 | 0 | 31 | 100 | 173 |
| Glass transition point (°C.) | 57 | 49 | 50 | 45 | 43 | 65 | 61 | 64 | 52 | 71 | 19 | 58 |

(2) Production of Toners

After premixing the materials shown in Table 2 in a Henschel mixer at one time, the resulting mixture was melt-kneaded in a kneader. After cooling, the kneaded material was pulverized by using a pin mill and a jet mill, followed by classification to give toners having an average particle size of 10 to 15 μm.

TABLE 2

| Toner No.*1 | C-1 | C-2 | C-3 | C-4 | C-5 | C-6 | C-7 | C-8 |
|---|---|---|---|---|---|---|---|---|

TABLE 2-continued

| | | | | | | | | | |
|---|---|---|---|---|---|---|---|---|---|
| Copolymer No. (g) | A-1 | 870 | | | | | | | |
| | A-2 | | 875 | | | | | | 410 |
| | A-3 | | | 870 | | | | | |
| | A-4 | | | | 860 | | | 420 | |
| | A-5 | | | | | 870 | | 420 | |
| | A-6 | | | | | | 860 | | 460 |
| | A-7 | | | | | | | | |
| | A-8 | | | | | | | | |
| | B-1 | | | | | | | | |
| | B-2 | | | | | | | | |
| | B-3 | | | | | | | | |
| | B-4 | | | | | | | | |
| Colorant: Carbon black #44*2 (g) | | 100 | 80 | 80 | 80 | 100 | 80 | 120 | 100 |
| Charge control*3 agent (g) | | 20 | 30 | 30 | 30 | 20 | 30 | 30 | 20 |
| Additive*4 (g) | | 10 | 15 | 20 | 30 | 10 | 30 | 30 | 10 |
| Magnetic powder*5 (g) | | | | | | | | | |
| Colorant/copolymer (weight %) | | 10.3/89.7 | 8.4/91.6 | 8.4/91.6 | 8.5/91.5 | 10.3/89.7 | 8.5/91.5 | 12.8/87.2 | 10.3/89.7 |
| Toner No.*1 | | C-9 | C-10 | C-11 | C-12 | D-1 | D-2 | D-3 | D-4 |
| Copolymer No. (g) | A-1 | 470 | | | | | | | |
| | A-2 | | | | | | | | |
| | A-3 | | | | | | | | |
| | A-4 | | | | | | | | |
| | A-5 | | 250 | | | | | | |
| | A-6 | | 200 | | | | | | |
| | A-7 | | | 900 | | | | | |
| | A-8 | | | | 900 | | | | |
| | B-1 | | | | | 870 | | | |
| | B-2 | | | | | | 870 | | |
| | B-3 | | | | | | | 870 | |
| | B-4 | | | | | | | | 870 |
| Colorant: Carbon black #44*2 (g) | | 10 | 10 | 50 | 50 | 100 | 100 | 100 | 100 |
| Charge control*3 agent (g) | | 30 | 30 | 20 | 20 | 20 | 20 | 20 | 20 |
| | | | | 10*6 | 10*6 | | | | |
| Additive*4 (g) | | 20 | 20 | 20 | 20 | 10 | 10 | 10 | 10 |
| Magnetic powder*5 (g) | | 470 | 490 | | | | | | |
| Colorant/copolymer (weight %) | | 2.1/97.9 | 2.1/97.9 | 5.3/94.7 | 5.3/94.7 | 10.3/89.7 | 10.3/89.7 | 10.3/89.7 | 10.3/89.7 |

Note
*1C-1 to C-12: Examples; D-1 to D-4: Comparative Examples
*2Carbon black #44 mfd. by Mitsubishi Chemical Industries, Ltd.
*3Fatty acid modified nigrosine dye, Oil Black SO, a trade name, mfd. by Orient Chemical Industries, Ltd.
*4Polypropylene, Viscole 660 P, a trade name mfd. by Sanyo Chemical Industries, Ltd.
*5MG-WS, a trade name, manufactured by Mitsui Mining & Smelting Co., Ltd., particle size: about 0.3 μm.
*6Dibutyl tin oxide.

(3) Evaluation Methods and Results

(3)-1: Resistance to adhesion to non-rigid polyvinyl chloride

A developer was prepared by mixing 48 g of a toner and 752 g of an iron powder carrier (Carrier Z-250, a trade name, mfd. by Nippon Iron Powder Co., Ltd.). Copies were produced by using a dry electrophotocopying machine (SF-750, a trade name, mfd. by Sharp Corp.).

One of the resulting copies was sandwiched between sheets of non-rigid polyvinyl chloride containing 25% by weight of dioctyl phthalate and the adhesiveness to the non-rigid polyvinyl chloride under the conditions of the temperature of 30° C., load 5 gm/cm$^2$, and the test time of 1800 hours was examined. When the copy did not adhere to the polyvinyl chloride without causing defects on the copied images, it was evaluated as ○, while when adhered to the non-rigid polyvinyl chloride causing defects of copied images, it was evaluated as X.

(3)-2: Resistance to Blocking under High Humidity

A toner in an amount of 5 g was placed in a petri dish and allowed to stand at 50° C., and a humidity of 91% RH for 18 hours to observe the growth of block. When there was no change before and after the test, the evaluation was made as ○, while when a block was formed and not destroyed easily, the evaluation was made as X.

(3)-3: Resistance to Blocking under Low Humidity

The same procedure as mentioned in about (3)-2 was repeated except for changing the humidity to 27% RH.

(3)-4: Moisture Absorption

A sample bottle containing about 5 g of a toner was placed in a desiccator containing silica gel and kept at 50° C. to remove moisture and to attain the constant weight. Then, the sample bottle as transferred to another desiccator kept at 20° C. and the humidity of 93% RH by using ammonium dihydrogenphosphate and moistened for 2 days. The increase of wight after the removal of moisture was regarded as the moisture absorption.

(3)-5: Image Density and Fog

After copying 20,000 sheets of paper in the same manner as described in (3)-1, the 20,000th sheet of copy was subjected to measurement of optical reflection densities at the black portions and white portions by using a Macbeth reflection densitometer (mfd. by Kollmorgen Corp.). The image density and fog were evaluated by using these measured values.

The results are as shown in Table 3.

As is clear from Table 3, the toners of this invention are excellent in resistance to adhesion to non-rigid polyvinyl chloride, and resistance to blocking under high humidity.

TABLE 3

| Example No. | Example 1 | Example 2 | Example 3 | Example 4 | Example 5 | Example 6 | Example 7 | Example 8 | Example 9 |
|---|---|---|---|---|---|---|---|---|---|
| Toner No. | C-1 | C-2 | C-3 | C-4 | C-5 | C-6 | C-7 | C-8 | C-9 |
| Adhesiveness to non-rigid PVC | | | | | | | | | |
| Resistance to blocking (91% RH) | | | | | | | | | |
| Resistance to blocking (27% RH) | | | | | | | | | |
| Moisture absorption (%) | 1.7 | 1.8 | 0.7 | 0.5 | 1.9 | 0.9 | 1.6 | 1.5 | 1.7 |
| Image density | >1.2 | >1.2 | >1.2 | >1.2 | >1.2 | >1.2 | >1.2 | >1.2 | >1.2 |
| Fog | 0.08 | 0.07 | 0.07 | 0.07 | 0.08 | 0.08 | 0.08 | 0.07 | 0.08 |

| Example No. | Example 10 | Example 11 | Example 12 | Comparative Example 1 | Comparative Example 2 | Comparative Example 3 | Comparative Example 4 |
|---|---|---|---|---|---|---|---|
| Toner No. | C-10 | C-11 | C-12 | D-1 | D-2 | D-3 | D-4 |
| Adhesiveness to non-rigid PVC | | | | X | X | | |
| Resistance to blocking (91% RH) | | | | | | X | X |
| Resistance to blocking (27% RH | | | | | | X | |
| Moisture absorption (%) | 1.7 | 1.6 | 1.6 | 0.4 | 0.8 | Not measured due to blocking | 2.5 |
| Image density | >1.2 | >1.2 | >1.2 | >1.2 | >1.2 | >1.2 | >1.2 |
| Fog | 0.07 | 0.08 | 0.07 | 0.08 | 0.07 | 0.07 | 0.08 |

What is claimed is:

1. A particulate toner for developing electrostatic images comprising at least one colorant and/or magnetic powder and a vinyl polymer having at least one group of the formula:

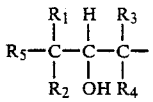

(I)

wherein $R_1$ through $R_5$ are independently hydrogen or a hydrocarbon group, in side chains of the polymer,

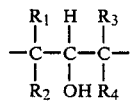

(II)

said vinyl polymer having a hydroxyl number of 50 to 350 and a glass transition point of 35 to 100° C.

2. A toner according to claim 1, wherein the hydrocarbon group is an alkyl group having 1 to 4 carbon atoms, or a phenyl group.

3. A toner according to claim 1, wherein the vinyl polymer is a polymer or copolymer obtained from one or more vinyl monomers having a secondary hydroxyl group of the formula (I).

4. A toner according to claim 3, wherein, the monomer having a secondary hydroxyl group of the formula (I) is at least one member selected from the group consisting of 2-hydroxypropyl methacrylate, 2-hydroxybutyl methacrylate, 3-hydroxybutyl methacrylate, 2-hydroxypropyl acrylate, 2-hydroxybutyl acrylate, and 3-hydroxybutyl acrylate;

5. A toner according to claim 1, wherein the vinyl polymer is a polymer or copolymer obtained from one or more vinyl monomers having a secondary hydroxyl group of the formula (I) or a copolymer of one or more vinyl monomers having a secondary hydroxyl group of the formula (I) and one or more vinyl monomers having a hydroxyl group other than the secondary hydroxyl group of the formula (I).

6. A toner according to claim 1, wherein the vinyl polymer is a copolymer obtained from at least one vinyl monomer having a secondary or other hydroxyl group of the formula (I) and one or more vinyl monomers copolymerizable with the vinyl monomer having a hydroxyl group, or these monomers and one or more vinyl monomer having a hydroxyl group other than the secondary hydroxyl group of the formula (I).

7. A toner according to claim 6, wherein the vinyl monomer copolymerizable with the vinyl monomer having a hydroxyl group is methacrylic acid or an ester thereof, acrylic acid or an ester thereof, styrene or a derivative thereof, vinyl acetate, vinyl chloride, acrylonitrile, methacrylonitrile, or butyl vinyl ether.

8. A toner according to claim 1, which comprises 1 to 60% by weight of one or more colorants.

9. A toner according to claim 1, which comprises 10 to 70% by weight of one or more magnetic powders.

10. A toner according to claim 1, wherein the content of the group of the formula (I) among total hydroxyl groups in the vinyl polymer is 60% or more.

11. A toner according to claim 1, wherein the amount of colorant is from 1 to 60% by weight based on the weight of the toner when used alone or 10% by weight or less when admixed with the magnetic powder, the amount of magnetic powder being from 10 to 70% by weight based on the weight of the toner.

* * * * *